US007999141B2

(12) United States Patent
Katoh et al.

(10) Patent No.: US 7,999,141 B2
(45) Date of Patent: Aug. 16, 2011

(54) PROCESS FOR PRODUCING GAS HYDRATE PELLET

(75) Inventors: Yuichi Katoh, Ichihara (JP); Kiyoshi Horiguchi, Ichihara (JP); Toru Iwasaki, Ichihara (JP); Shigeru Nagamori, Ichihara (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 267 days.

(21) Appl. No.: 12/225,808

(22) PCT Filed: Mar. 30, 2008

(86) PCT No.: PCT/JP2006/306746

§ 371 (c)(1),
(2), (4) Date: Sep. 30, 2008

(87) PCT Pub. No.: WO2007/116456

PCT Pub. Date: Oct. 18, 2007

(65) Prior Publication Data

US 2009/0247797 A1 Oct. 1, 2009

(51) Int. Cl.
*C07C 7/20* (2006.01)

(52) U.S. Cl. ..... 585/15; 62/45.1; 426/67

(58) Field of Classification Search ..... 585/15
See application file for complete search history.

(56) References Cited

U.S. PATENT DOCUMENTS

| | | | | |
|---|---|---|---|---|
| 5,536,893 | A * | 7/1996 | Gudmundsson | 585/15 |
| 6,149,951 | A * | 11/2000 | Bee et al. | 426/67 |
| 2005/0059846 | A1 * | 3/2005 | Kohda et al. | 585/15 |
| 2007/0100178 | A1 * | 5/2007 | Carstens et al. | 585/15 |
| 2008/0103343 | A1 * | 5/2008 | Balczewski | 585/15 |
| 2009/0062579 | A1 * | 3/2009 | Nazari et al. | 585/15 |
| 2009/0287028 | A1 * | 11/2009 | Iwasaki et al. | 585/15 |

FOREIGN PATENT DOCUMENTS

| | | | |
|---|---|---|---|
| JP | 2001-342473 | A | 12/2001 |
| JP | 2002-220353 | A | 8/2002 |
| JP | 2004-067992 | A | 3/2004 |
| JP | 2005-263675 | A | 9/2005 |
| JP | 2006-052261 | A | 2/2006 |
| JP | 2006-104256 | A | 4/2006 |
| JP | 2006-104258 | A | 4/2006 |

* cited by examiner

*Primary Examiner* — Ellen M McAvoy
(74) *Attorney, Agent, or Firm* — Kubovcik & Kubovcik

(57) ABSTRACT

A process for producing gas hydrate pellets includes generating a gas hydrate by reacting raw gas and raw water under predetermined temperature and pressure conditions, and then shaping the gas hydrate into pellets by means of a pelletizer. Newly-formed gas hydrate or still-moist gas hydrate that has been partially dehydrated is shaped into pellets by means of a pelletizer, the shaping being conducted under conditions of the gas hydrate formation temperature and formation pressure. Subsequently, the shaped pellets are cooled to a sub-zero temperature by means of a refrigerating machine.

4 Claims, 8 Drawing Sheets

PROCESS FOR PRODUCING GAS HYDRATE PELLET

BACKGROUND OF THE INVENTION

1. Field of the Invention

The present invention relates to a process for producing gas hydrate pellets, wherein a gas hydrate is first formed by reacting raw gas with raw water under predetermined temperature and pressure conditions, and subsequently shaping the gas hydrate into pellets by means of a pelletizer.

2. Description of the Related Art

In the past, proposals have been made wherein gas hydrate powder is first shaped into pellets by means of a pelletizer, and subsequently this pelletized gas hydrate is stored in a storage tank on land or in the hold of a ship (see Japanese patent application Kokai publication No. 2002-220353, for example).

Meanwhile, a continuous process for producing gas hydrate pellets as shown in FIG. 8 has also been conceived. In this process, raw gas (g) at high pressure (5.4 MPa, for example) and raw water (w) at a set temperature (4° C., for example) are fed into a first generator 1 to generate gas hydrate slurry (gas hydrate concentration: 20 wt %). The gas hydrate slurry is then physically dehydrated using a dehydrating machine 2 (gas hydrate concentration: 70 wt %). Subsequently, the dehydrated gas hydrate is fed into a second generator 3 and again reacted with raw gas (g) and hydrated/dehydrated (gas hydrate concentration: 90 wt %). Additionally, this powdered gas hydrate (a) is then cooled to a sub-zero temperature (−20° C., for example) by means of a refrigerating machine 4, thereby causing the gas hydrate to exhibit self-preservation at atmospheric pressure. In order to store the gas hydrate at atmospheric pressure, the gas hydrate is then depressurized from the gas hydrate formation pressure (5.4 MPa) to atmospheric pressure (0.1 MPa) by means of a depressurizing device 5. Subsequently, the gas hydrate is machined into pellets (p) by means of a pelletizer 6.

However, in order to store the gas hydrate at atmospheric pressure, the gas hydrate is cooled to a sub-zero temperature (−20° C., for example) by means of the refrigerating machine 4, dry powder of gas hydrate (a) is then depressurized from the pressure conditions maintained by the refrigerating machine 4 (5.4 MPa) to atmospheric pressure (0.1 MPa). If the powdered gas hydrate (a) is shaped into pellets (p) by means of the pelletizer 6 after conducting the above, there is a problem in that the gas hydrate concentration decreases by 15 wt % to 30 wt %.

In other words, the powdered gas hydrate (a), having been cooled to a sub-zero temperature (−20° C., for example) by means of the refrigerating machine 4, exists in a formation region X; more specifically, the gas hydrate (a) is subject to the conditions labeled A in FIG. 7 (5.4 MPa, −20° C. (257 K)). However, if the gas hydrate (a) is depressurized to atmospheric pressure, the gas hydrate (a) enters an unstable decomposition region Y; more specifically, the gas hydrate (a) becomes subject to the conditions labeled B in FIG. 7 (0.1 MPa, −20° C. (257 K)). Normally, gas hydrate in such a state exhibits self-preservation and the gas decomposition amount decreases. However, the gas decomposition does occur in the decomposition region until self-preservation is exhibited, and thus the decomposition amount is increased. In particular, the decomposition amount for powdered gas hydrate having a small grain size is significantly increased, due to the large specific surface area of such gas hydrate.

In addition, it has been found that if the pellet formation pressure in the pelletizer is increased, gas hydrate grains fracture and the gas decomposition amount increases. If the formation pressure is then suppressed as a result, gaps (e) occur in a pellet (p) between particles of the gas hydrate (a), as shown in FIG. 9. As a result, the specific surface area related to pellet decomposition becomes larger, and the decomposition amount is large even after pelletizing.

On the other hand, gas hydrate having a small grain size is strongly adhesive, and may cause blockage in the depressurizing device 5 or its surrounding pipes. As a result, there is a problem in that pellets can no longer be continuously produced.

SUMMARY OF THE INVENTION

The present invention, being devised in order to solve such problems, has as an object to provide a process for producing gas hydrate pellets wherein gas hydrate decomposition is suppressed during depressurization and pellet formation, and thus gas hydrate concentration is high, and additionally, wherein the gas decomposition amount is low while in storage.

Another object of the present invention is to provide a process for producing gas hydrate pellets that do not readily cause blockage in a depressurization device or its surrounding pipes.

In order to solve the problems described above, the present invention is configured as follows. In the process for producing gas hydrate pellets in accordance with the invention according to claim 1, gas hydrate is first formed by reacting raw gas and raw water under predetermined temperature and pressure conditions. The gas hydrate is then shaped into pellets by means of a pelletizer under conditions of the gas hydrate formation temperature and formation pressure, wherein the gas hydrate used is newly-formed gas hydrate or still-moist gas hydrate that has been partially dehydrated. Subsequently, the shaped pellets are cooled to a sub-zero temperature by means of a refrigerating machine.

The process for producing has gas hydrate pellets in accordance with the invention according to claim 2 involves the following. In the process for producing gas hydrate pellets according to claim 1, after gas hydrate formation, gas hydrate having a gas hydrate concentration between 70 wt % and 95 wt % is shaped into pellets.

The process for producing gas hydrate pellets in accordance with the invention according to claim 3 involves the following. In the process for producing gas hydrate pellets according to claim 1, partially dehydrated gas hydrate having a gas hydrate concentration between 30 wt % and 70 wt % is shaped into pellets.

The process for producing gas hydrate pellets in accordance with the invention according to claim 4 involves the following. Gas hydrate is first formed by reacting raw gas and raw water under predetermined temperature and pressure conditions. The gas hydrate is then shaped into pellets by means of a pelletizer, wherein after forming the gas hydrate, the gas hydrate is cooled to a sub-zero temperature, and subsequently shaped into pellets by means of the pelletizer under conditions of the gas hydration formation pressure.

As described above, the invention according to claim 1 shapes gas hydrate into pellets by means of a pelletizer under conditions of the gas hydrate formation temperature and formation pressure, wherein the gas hydrate used is newly-formed gas hydrate or still-moist gas hydrate that has been partially dehydrated. In so doing, gas hydrate pellets are formed that are tightly compacted and solid, while also being translucent due to the included water in the slight gaps between gas hydrate grains.

Furthermore, these pellets are practically solid, with a smaller specific surface area related to decomposition compared to pellets of the related art having gaps between gas hydrate grains. For this reason, hardly any decomposition occurs when using the depressurizing device to reduce the pressure from a stable formation region (5.4 MPa, for example) to unstable atmospheric pressure (0.1 MPa). Moreover, since only the outer surface of the pellets is exposed to air, the gas decomposition amount during storage is smaller compared to that of the porous gas hydrate pellets of the related art. Thus, the high gas hydrate concentration at the time of gas hydrate formation is maintained at almost the same level.

Furthermore, since in the present invention the pellets are cooled to a sub-zero temperature (−20° C., for example) by means of a refrigerating machine, the water existing between gas hydrate grains freezes, thereby hardening the pellets and making decomposition even more difficult. In addition, since the pellets are tightly compacted with physical dimensions that are much greater than those of the powder, the pellets do not adhere to the depressurizing device or other equipment.

In the invention according to claim 2, newly-formed gas hydrate having a gas hydrate concentration between 70 wt % and 95 wt % is shaped into pellets. In so doing, gas hydrate pellets are formed that are tightly compacted and solid, while also being translucent due to the included water in the slight gaps between gas hydrate grains. Moreover, as described above, these pellets are practically solid, with a smaller specific surface area related to decomposition compared to pellets of the related art having gaps between gas hydrate grains. For this reason, hardly any decomposition occurs even when using the depressurizing device to reduce the pressure from a stable formation region (5.4 MPa, for example) to unstable atmospheric pressure (0.1 MPa).

In the invention according to claim 3, partially dehydrated gas hydrate having a gas hydrate concentration between 30 wt % and 70 wt % is shaped into pellets. In so doing, gas hydrate pellets are formed that are tightly compacted and solid, while also being translucent due to the included water in the slight gaps between gas hydrate grains. Moreover, since the gaps between gas hydrate grains are filled with water, these pellets have a smaller specific surface area related to decomposition compared to pellets of the related art having gaps between gas hydrate grains. For this reason, hardly any decomposition occurs even when using the depressurizing device to reduce the pressure from a stable formation region (5.4 MPa, for example) to unstable atmospheric pressure (0.1 MPa).

In the invention according to claim 4, newly-formed gas hydrate is cooled to a sub-zero temperature, and subsequently, the gas hydrate is shaped into pellets by means of a pelletizer under conditions of the gas hydrate formation pressure. In so doing, reduction in the contained gas ratio of the pellets is suppressed.

DETAILED DESCRIPTION OF THE INVENTION

Hereinafter, embodiments of the present invention will be described with reference to the accompanying drawings.

(1) First Embodiment

Figure 1:
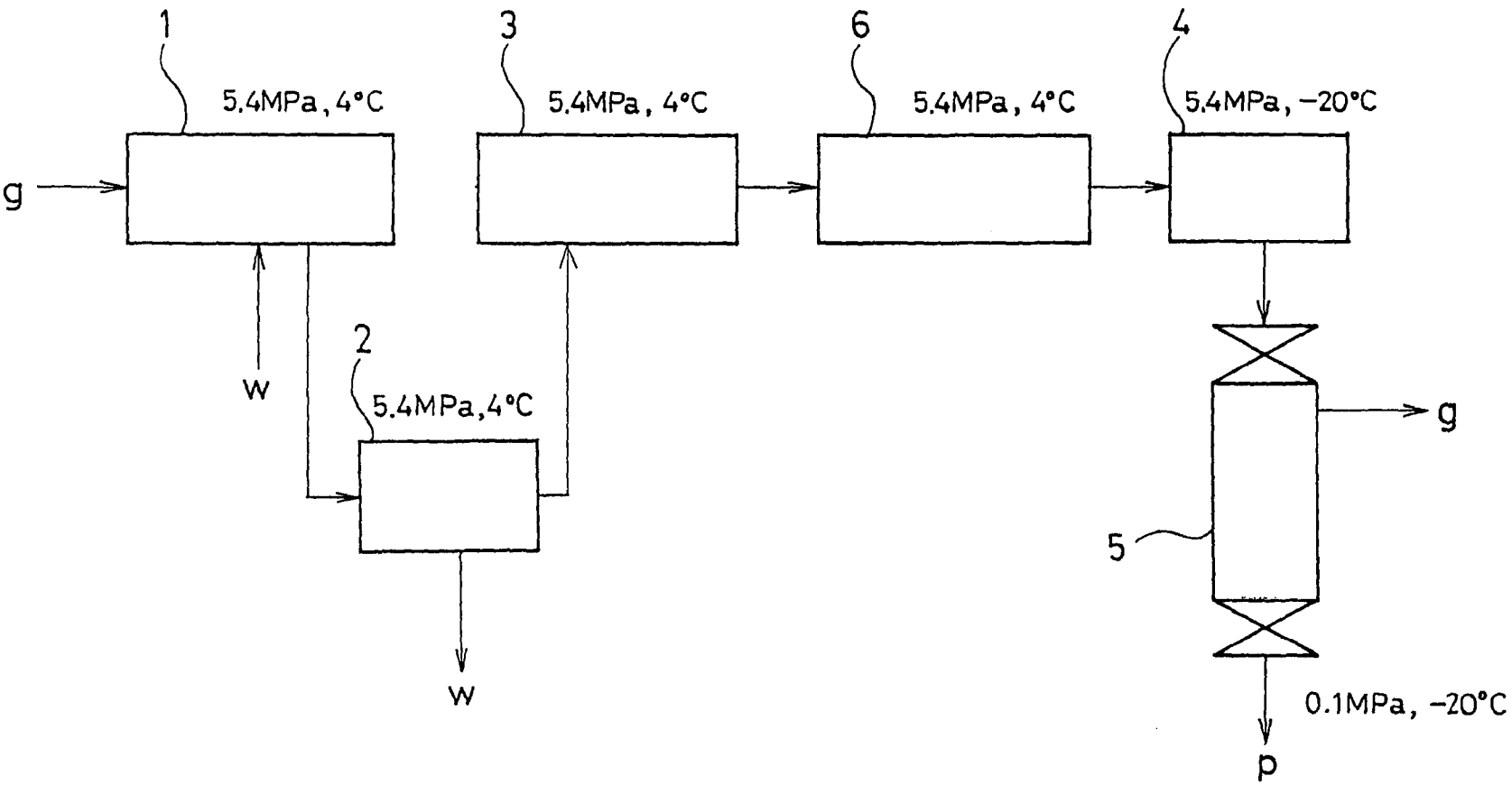
FIG. 1 is a first process flowchart for carrying out a process for producing gas hydrate pellets in accordance with the present invention.

FIG. 1 shows a first generator 1, a dehydrating machine 2, a second generator 3, a refrigerating machine 4, a depressurizing device 5, and a pelletizer 6. Raw gas (natural gas) (g) under high pressure (5.4 MPa, for example) is fed into the first generator 1 with raw water (w) at a set temperature (4° C., for example). The raw gas (g) and the raw water (w) are then reacted using an arbitrary method, such as a stirring method or a bubbling method, thereby forming gas hydrate slurry (exemplary gas hydrate concentration: 20 wt % to 30 wt %). During slurry formation, reaction heat is removed by means of a refrigerating machine not shown in the drawings.

If the gas hydrate formation herein is conducted at over the freezing point (273 K), then ordinarily the formation pressure becomes a value between 3.5 MPa (273 K) and 8 MPa (284 K). If the temperature conditions for producing pellets under high pressure are taken to include the range of −20° C. to 0° C., then the formation pressure becomes a value between 253 K (2 MPa) and 284 K (8 MPa).

The gas hydrate slurry generated by the first generator 1 is then physically dehydrated by means of the dehydrating machine 2. After being physically dehydrated by means of the dehydrating machine 2, gas hydrate having a gas hydrate concentration between 40 wt % and 50 wt % is fed into the second generator 3. In the second generator 3, raw gas (g) from the first generator 1 is fed and hydrated with unreacted raw water (w), thereby raising the gas hydrate concentration to approximately 90 wt %. Similarly to the first generator 1, reaction heat is removed from the second generator 3 by means of a refrigerating machine not shown in the drawings.

Figure 3:
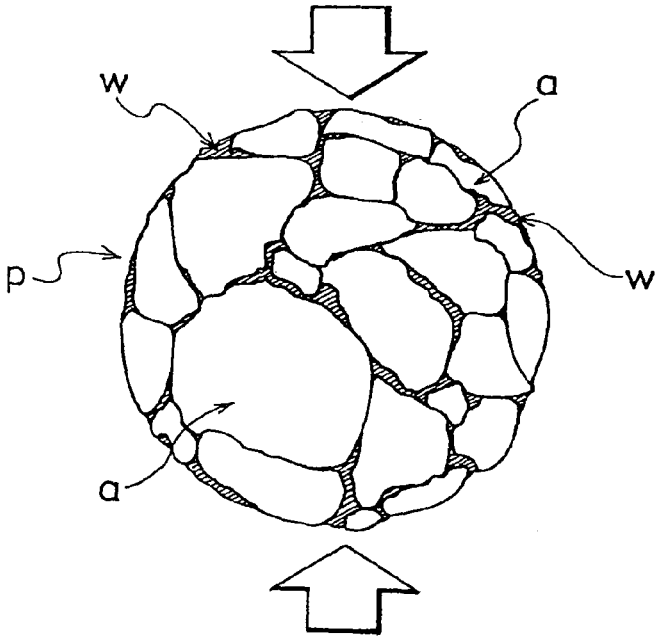
FIG. 3 is a lateral view of a pellet produced using the process of the present invention.

After having been hydrated and dehydrated in the second generator 3, the gas hydrate is then shaped into pellets of arbitrary shape (such as spherical, lenticular, or briquette shapes) and size (approximately 5 mm to 30 mm, for example) by means of the pelletizer 6. Since the gas hydrate that was dehydrated in the second generator 3 still retains some moisture, shaping the gas hydrate into pellets by means of the pelletizer 6 yields pellets (p) having a tightly compacted shape as shown in FIG. 3 (in the case of the figure, a spherical, lenticular, or briquette shape), the pellets also being translucent due to the included water (w) in the slight gaps between adjacent gas hydrate grains (a).

Herein, the gas hydrate concentration during pellet formation is preferably in the range of 70 wt % to 95 wt %. If the gas hydrate concentration after formation exceeds 95 wt %, then moisture in the gas hydrate is low, and thus it becomes difficult to yield pellets without gaps. In contrast, if the gas hydrate concentration is less than 70 wt %, then the amount of contained gas is reduced due to the large amount of moisture.

Subsequently, the gas hydrate pellets are cooled to a sub-zero temperature (−20° C., for example) by means of the refrigerating machine 4, thereby causing the water (w) in the gaps between gas hydrate grains (a) to freeze, thus yielding harder pellets. Subsequently, the pellets are depressurized from the gas hydrate formation pressure (5.4 MPa) to atmospheric pressure (0.1 MPa) by means of the depressurizing device 5, and then stored in a storage tank (not shown in the drawings).

Figure 2:
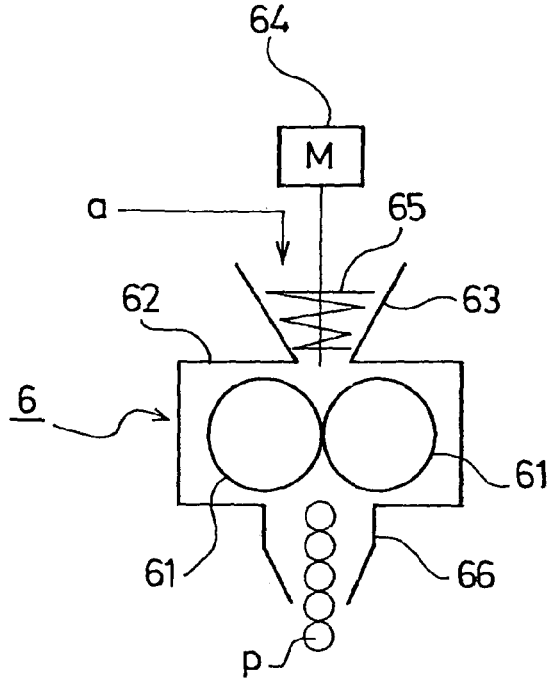
FIG. 2 is a schematic diagram showing the configuration of a pelletizer.

An arbitrary pelletizer may be used as the pelletizer 6. However, since the pelletizer is used under high pressure conditions (5.4 MPa, for example), it is preferable to use a briquetting roll pelletizer as shown in FIG. 2, wherein gas hydrate (a) is captured and compressed by pellet-shaped molds (pockets) provided on the surface of a pair of rotary rolls 61, thereby forming pellets (p). FIG. 2 shows a briquetting roll pelletizer having a pair of rotary rolls 61, a housing body 62, a hopper 63, a motor 64 that causes a screw 65 inside the hopper 63 to rotate, and a shooter 66.

(2) Second Embodiment

Figure 4:
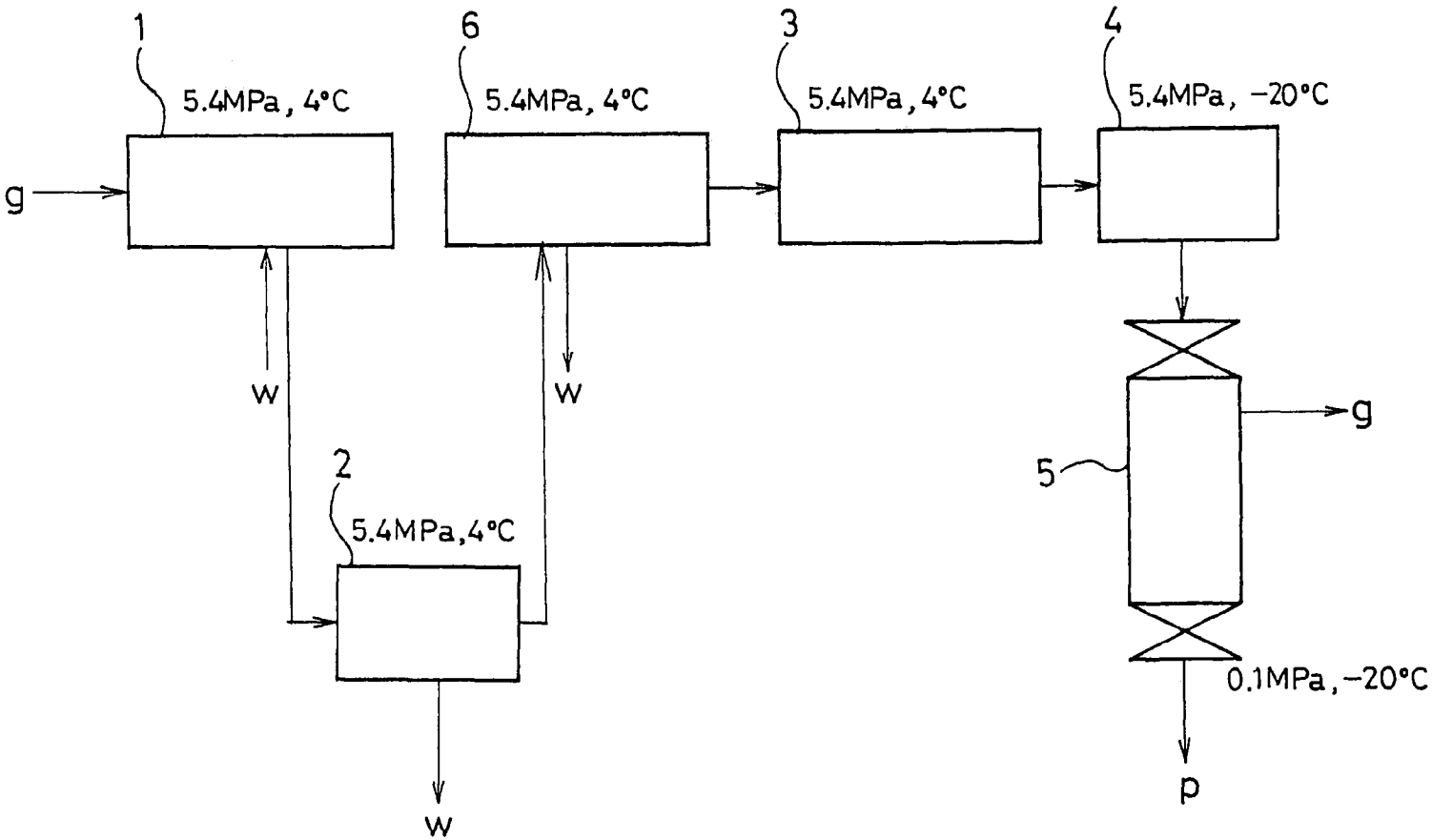
FIG. 4 is a second process flowchart for carrying out a process for producing gas hydrate pellets in accordance with the present invention.

FIG. 4 shows a first generator 1, a dehydrating machine 2, a second generator 3, a refrigerating machine 4, a depressurizing device 5, and a pelletizer 6. Raw gas (natural gas) (g) under high pressure (5.4 MPa, for example) is fed into the first generator 1 with raw water (w) at a set temperature (4° C., for example). The raw gas (g) and the raw water (w) are then reacted using an arbitrary method, such as a stirring method or a bubbling method, thereby forming gas hydrate slurry. During slurry formation, reaction heat is removed by means of a refrigerating machine not shown in the drawings.

The gas hydrate slurry generated by the first generator 1 is then physically dehydrated by means of the dehydrating machine 2. At this stage, the gas hydrate is in a nearly powder-like state having a gas hydrate concentration between 40 wt % and 50 wt %. However, by using a pelletizer 6 having dehydration functions, the gas hydrate is shaped into pellets while extracting excess water (w), thereby yielding pellets having a gas hydrate concentration between 70 wt % and 80 wt %. The water obtained as a result of dehydration is reverted to raw water (w).

The pellets shaped by the pelletizer 6 are then fed into the second generator 3. In the second generator 3, by feeding in raw gas (g) from the first generator 1 and reacting (i.e., hydrating) again with unreacted raw water (w), the gas hydrate concentration of the pellets becomes approximately 90 wt %. Similarly to the first generator 1, reaction heat is removed from the second generator 3 by means of a refrigerating machine not shown in the drawings.

After having been hydrated and dehydrated in the second generator 3, the gas hydrate pellets are fed into the refrigerating machine 4 and cooled to a sub-zero temperature (−20° C., for example). In so doing, water (w) freezes in the gaps between gas hydrate grains (a), resulting in harder pellets. Subsequently, the pellets are depressurized from the gas hydrate formation pressure (5.4 MPa) to atmospheric pressure (0.1 MPa) by means of the depressurizing device 5, and then stored in a storage tank (not shown in the drawings).

Herein, the gas hydrate concentration of the partially dehydrated gas hydrate (i.e., the gas hydrate dehydrated by the dehydrating machine 2) is preferably in the range of 30 wt % to 70 wt %.

(3) Third Embodiment

Figure 5:
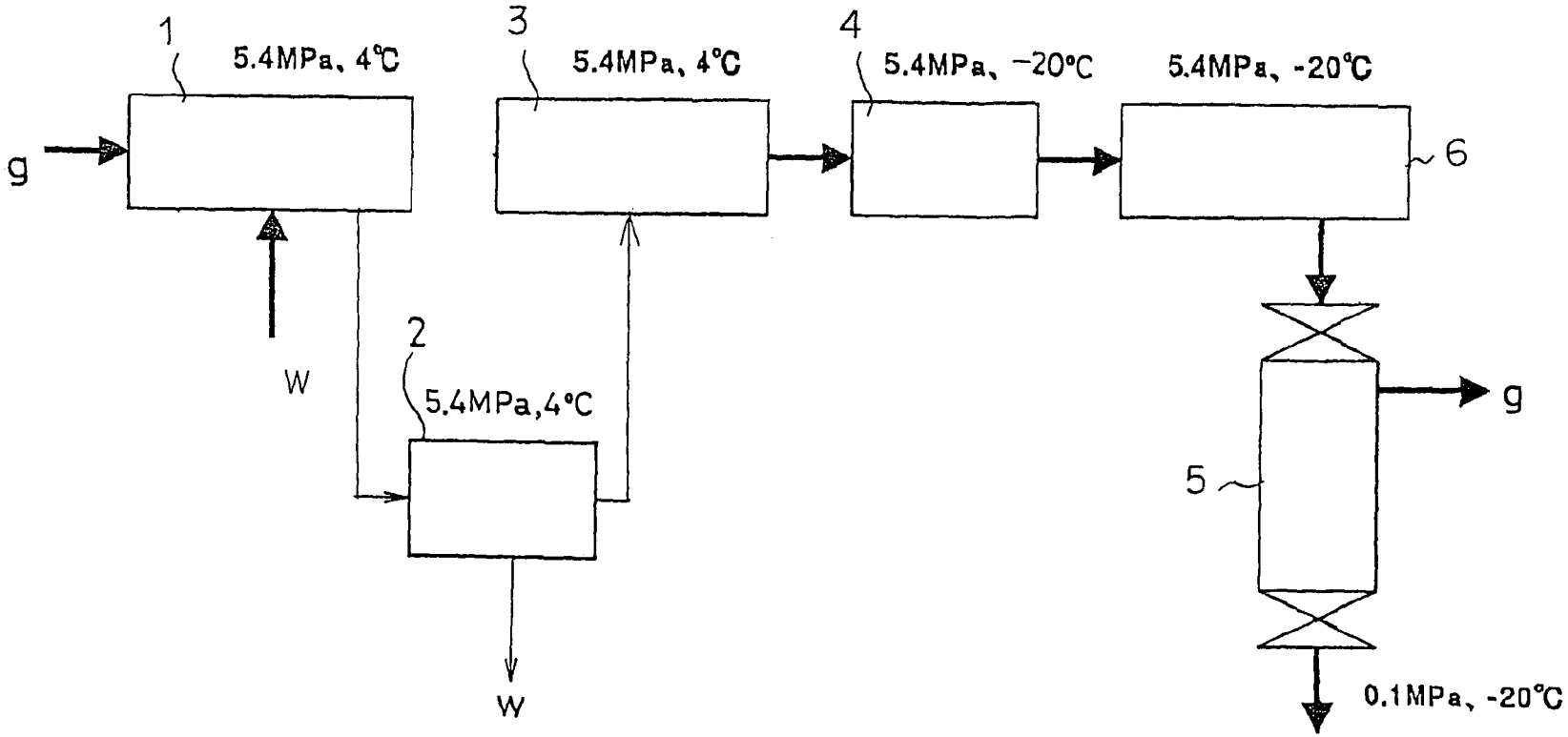
FIG. 5 is a third process flowchart for carrying out a process for producing gas hydrate pellets in accordance with the present invention.

FIG. 5 shows a first generator 1, a dehydrating machine 2, a second generator 3, a refrigerating machine 4, a depressurizing device 5, and a pelletizer 6. Raw gas (natural gas) (g) under high pressure (5.4 MPa, for example) is fed into the first generator 1 with raw water (w) at a set temperature (4° C., for example). The raw gas (g) and the raw water (w) are then reacted using an arbitrary method, such as a stirring method or a bubbling method, thereby forming gas hydrate slurry. During slurry formation, reaction heat is removed by means of a refrigerating machine not shown in the drawings.

The gas hydrate slurry generated in the first generator 1 is then physically dehydrated by means of the dehydrating machine 2. At this stage, the gas hydrate is in a nearly powder-like state having a gas hydrate concentration between 40 wt % and 50 wt %. The gas hydrate is then fed into the second generator 3. In the second generator 3, raw gas (g) from the first generator 1 is fed and hydrated with unreacted raw water (w), thereby raising the gas hydrate concentration to approximately 90 wt %. Similarly to the first generator 1, reaction heat is removed from the second generator 3 by means of a refrigerating machine not shown in the drawings.

After having been hydrated and dehydrated in the second generator 3, the gas hydrate is cooled to a sub-zero temperature (−20° C., for example) by means of the refrigerating machine 4. After being cooled to a sub-zero temperature (−20° C., for example) by means of the refrigerating machine 4, the gas hydrate is then shaped into pellets of arbitrary shape (such as spherical, lenticular, or briquette shapes) and size (approximately 5 mm to 30 mm, for example) by means of the pelletizer 6.

Subsequently, the gas hydrate pellets are depressurized from the gas hydrate formation pressure (5.4 MPa) to atmospheric pressure (0.1 MPa) by means of the depressurizing device 5, and then stored in a storage tank (not shown in the drawings).

As described above, the gas hydrate is cooled to a sub-zero temperature and subsequently pelletized by means of the pelletizer 6 before being released to atmospheric pressure. In so doing, harder pellets can be obtained, and thus reduction in the rate of contained gas in the gas hydrate pellets is suppressed.

In the present embodiment, an arbitrary pelletizer may be used as the pelletizer 6. However, since the pelletizer is used under the high pressure formation conditions (5.4 MPa, for example), it is preferable to use a briquetting roll pelletizer as shown in FIG. 2, wherein gas hydrate (a) is captured and compressed by pellet-shaped molds (pockets) provided on the surface of a pair of rotary rolls 61, thereby forming pellets (p).

Figure 6:
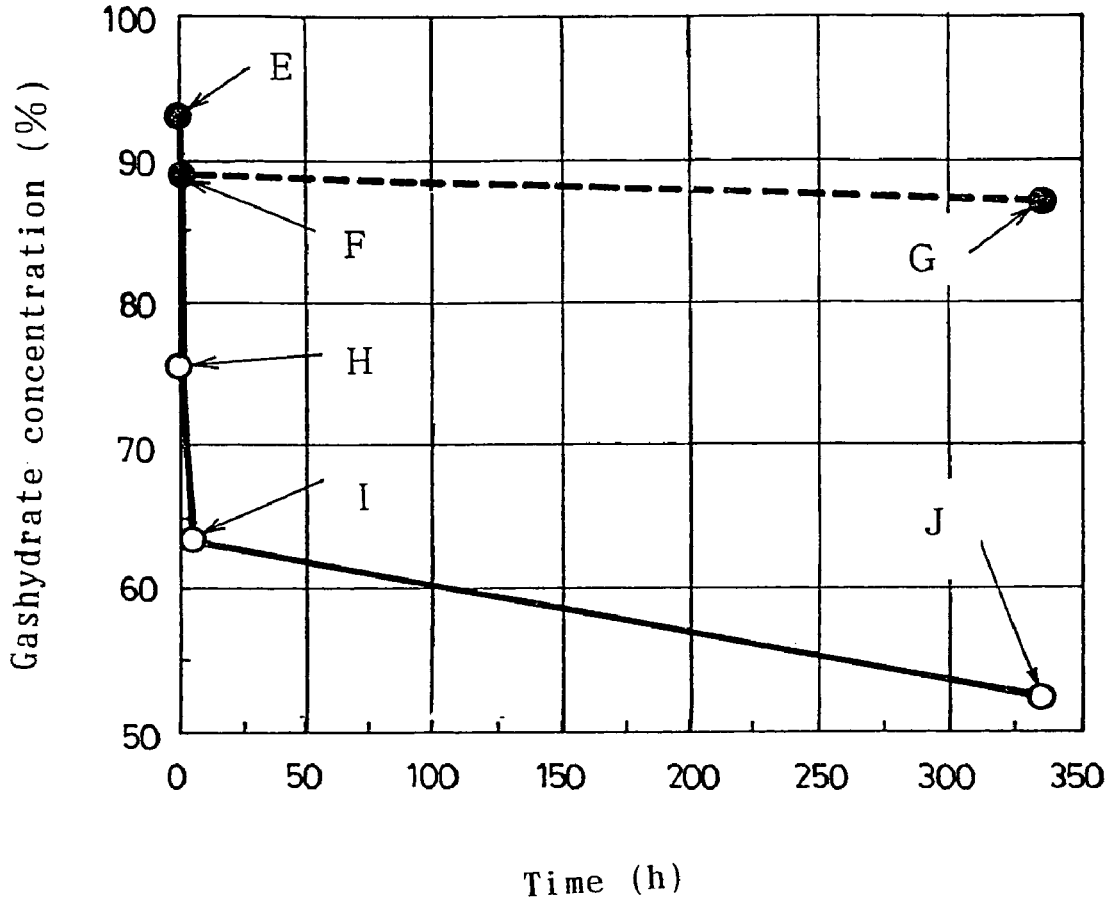
FIG. 6 is a diagram illustrating the relationship between the gas hydrate concentration (%) and the change in gas hydrate concentration in each step (time (h)).
Figure 7:
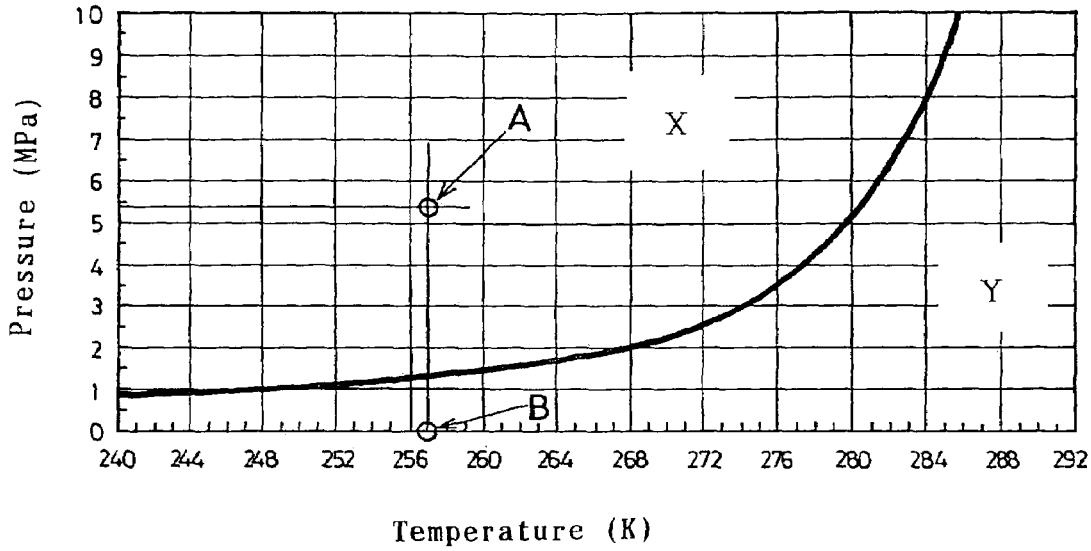
FIG. 7 shows the equilibrium curve for methane hydrate.
Figure 8:
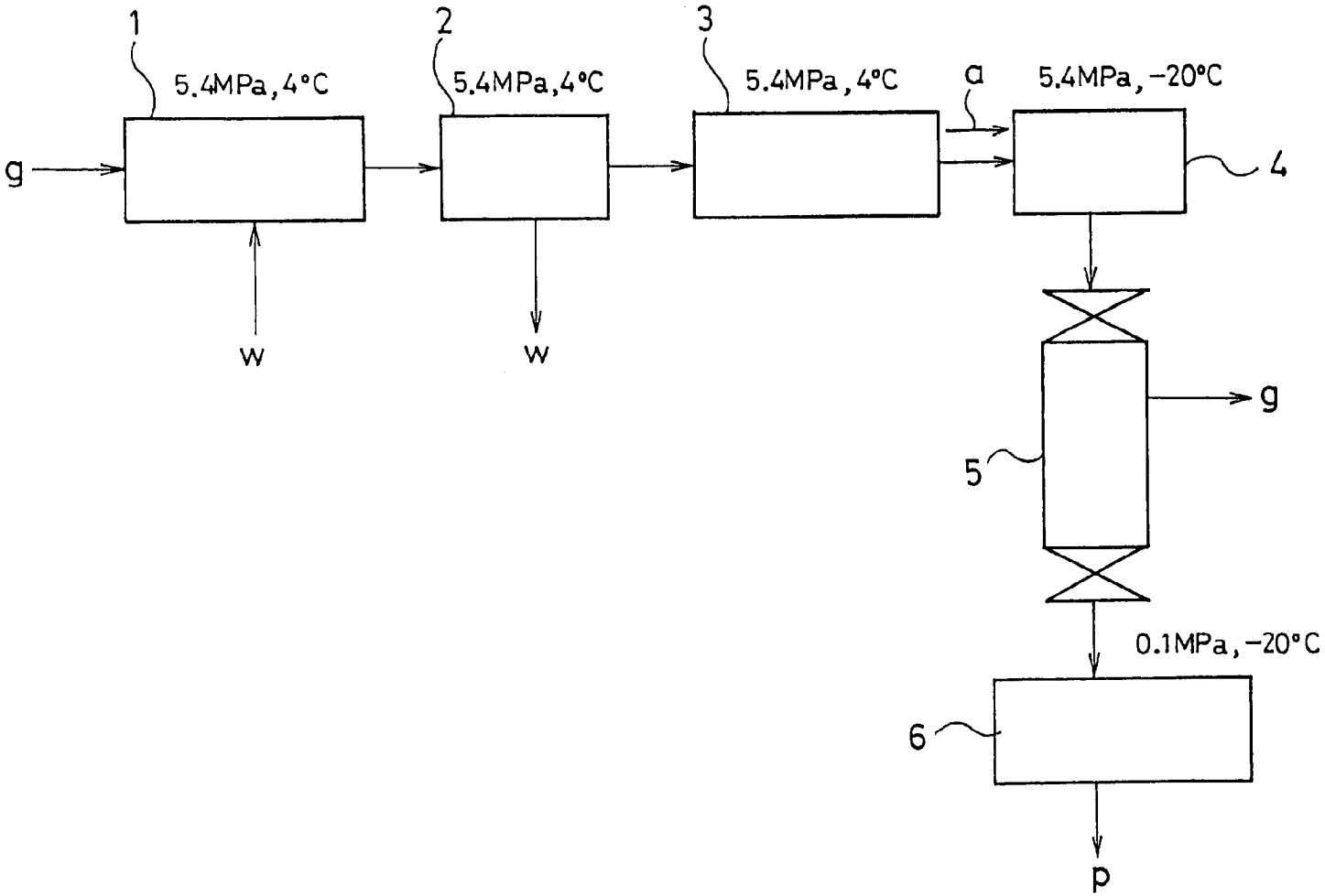
FIG. 8 is a schematic diagram showing the configuration of a process for producing gas hydrate of the related art.
Figure 9:
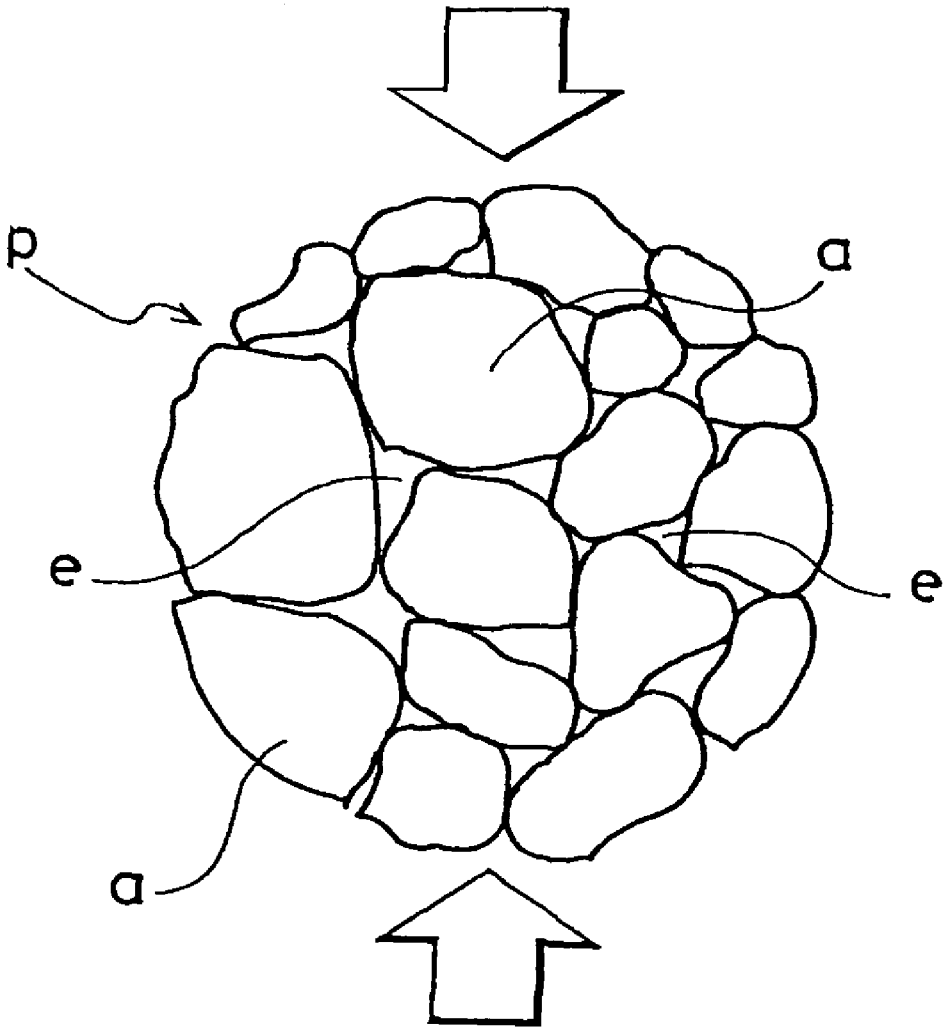
FIG. 9 is a lateral view of a pellet produced using the method of the related art.

FIG. 6 is a diagram illustrating the relationship between the gas hydrate concentration (%) and the change in gas hydrate concentration in each step (time (h)). As shown in FIG. 6, the concentration of newly-formed gas hydrate (point E) is 93 wt %. In the present invention, the gas hydrate concentration after depressurization (point F) is 89 wt %, and the gas hydrate concentration after storage (point G) is 87 wt %.

In contrast, in the related art, the gas hydrate concentration after depressurization (point H) is 76 wt %, the gas hydrate concentration after shaping (point I) is 63 wt %, and the gas hydrate concentration after storage (point J) is 52 wt %. Thus it can be seen that gas hydrate concentrations in the present invention are significantly higher than those of the related art.

What is claimed is:

1. A process for producing gas hydrate pellets, comprising the steps of:

generating a gas hydrate by reacting raw gas and raw water under predetermined temperature and pressure conditions;

shaping the gas hydrate into pellets by means of a pelletizer; and after the shaping step, cooling the shaped pellets to a sub-zero temperature by means of a refrigerating machine;

wherein during the shaping step, newly-formed gas hydrate that is a still-moist gas hydrate that has been partially dehydrated is shaped into pellets in which water is stall included in the gaps between adjacent gas hydrate grains under conditions of the gas hydrate formation temperature and formation pressure and further, the pellets are cooled to a sub-zero temperature so as to cause the included water in the gaps between the adjacent gas hydrate grains to be frozen.

2. The process for producing gas hydrate pellets according to claim 1, wherein, during the shaping of the pellets, the newly-formed gas hydrate has a gas hydrate concentration between 70 wt % and 95 wt %.

3. A process for producing gas hydrate pellets, comprising the steps of:

generating a gas hydrate by reacting raw gas and raw water under predetermined temperature and pressure conditions;

shaping the gas hydrate into pellets by means of a first pelletizer; and after the shaping step, cooling the shaped pellets to a sub-zero temperature by means of a refrigerating machine;

wherein during the shaping step, newly-formed gas hydrate that is a still-moist gas hydrate that has been partially dehydrated is shaped into pellets in which water is still included in the gaps between adjacent gas hydrate grains under conditions of the gas hydrate formation temperature and formation pressure, while extra water is removed by a second pelletizer having a function of dehydration and further, after the pellets are dehydrated in the second pelletizer, the pellets are cooled to a sub-zero temperature so as to cause the included water in the gaps between the adjacent gas hydrate grains to be frozen.

4. The process for producing gas hydrate pellets according to claim 3, wherein partially dehydrated gas hydrate having a gas hydrate concentration between 30 wt % and 70 wt % is shaped into pellets.

* * * * *